US006832712B2

(12) United States Patent
Turner

(10) Patent No.: US 6,832,712 B2
(45) Date of Patent: Dec. 21, 2004

(54) WATERPROOF PERSONAL STORAGE SYSTEM

(76) Inventor: Thomas James Turner, 11646 N. 38th Pl., Phoenix, AZ (US) 85028

( * ) Notice: Subject to any disclaimer, the term of this patent is extended or adjusted under 35 U.S.C. 154(b) by 0 days.

(21) Appl. No.: 10/679,133

(22) Filed: Oct. 2, 2003

(65) Prior Publication Data

US 2004/0069828 A1 Apr. 15, 2004

Related U.S. Application Data

(60) Provisional application No. 60/495,337, filed on Aug. 14, 2003, and provisional application No. 60/417,680, filed on Oct. 9, 2002.

(51) Int. Cl.[7] ..... A45F 3/00

(52) U.S. Cl. ..... 224/660; 224/230; 224/235; 224/662

(58) Field of Search ..... 224/230, 235, 224/236, 660, 662; 2/67

(56) References Cited

U.S. PATENT DOCUMENTS

| | | | | | |
|---|---|---|---|---|---|
| 1,689,396 | A | * | 10/1928 | Lang | 224/235 |
| 2,107,216 | A | * | 2/1938 | Rogers | 383/33 |
| 2,609,980 | A | * | 9/1952 | Morgenstern | 224/235 |
| 3,190,513 | A | * | 6/1965 | Wheeler | 224/235 |
| 4,905,857 | A | * | 3/1990 | Her | 224/664 |
| 6,237,152 | B1 | * | 5/2001 | Gootrad | 2/67 |
| 6,435,392 | B1 | * | 8/2002 | Kennedy | 224/680 |

* cited by examiner

*Primary Examiner*—Gary E. Elkins
(74) *Attorney, Agent, or Firm*—Martin L. Stoneman

(57) ABSTRACT

A wearable waterproof storage system for protecting personal accessories, such as mobile phones and wallets, from water damage and/or the threat of theft. The system consists of a waterproof pouch with a screw-on cap, sewn into a wearable outer protective cover. Illustrated embodiments include a belted waist-pack and an article of clothing consisting of short trousers. The system is constructed from water-resistant and waterproof materials.

24 Claims, 4 Drawing Sheets

WATERPROOF PERSONAL STORAGE SYSTEM

CROSS-REFERENCE TO RELATED APPLICATIONS

The present application is related to and claims priority from prior provisional applications Ser. No. 60/417,680, filed Oct. 9, 2002, entitled "WATERPROOF PERSONAL STORAGE SYSTEM", and Ser. No. 60/495,337, filed Aug. 14, 2003, entitled "WATERPROOF PERSONAL STORAGE SYSTEM", the contents of which are incorporated herein by this reference and are not admitted to be prior art with respect to the present invention by the mention in this cross-reference section.

BACKGROUND

This invention relates to providing a wearable waterproof storage system for protecting personal accessories, such as mobile phones and wallets, from water damage and/or the threat of theft.

Tourists, vacationers and aquatic-sport participants frequently find themselves in a public aquatic environment, such as a beach or pool, without an effective method for protecting personal valuables and accessories. Persons who are swimming or wading in water and desire to protect personal items, such as a mobile-phone, wallet, passport and the like from water damage or theft, have few options. Often, the person must choose between leaving the valuables in a dry area while engaging in the water activity or, alternatively, holding the valuables in a position that prevents or limits water damage. A relatively compact, easily accessible and waterproof personal storage system that can be worn about the body would permit safe and convenient storage of personal items, while the wearer is engaged in aquatic activities.

OBJECTS AND FEATURES OF THE INVENTION

A primary object and feature of the present invention is to provide a system for the protected storage of personal accessories by providing waterproof encasement about the stored personal accessories. It is a further object and feature of the present invention to provide such a system that may be securely worn about the body of a person. It is another object and feature of the present invention to provide such a system that provides easy access to the protected personal accessories by utilizing a simple screw-on cap arrangement. It is another object and feature of the present invention to provide such a system that positions the screw-on cap assembly away from the body of the wearer.

It is another object and feature of the present invention to provide such a system that provides access of sufficient size to permit passage of a thumb and at least one finger into the interior of the waterproof encasement. It is another object and feature of the present invention to provide such a system that may be worn around the waist of a person. It is yet another object and feature of the present invention to provide such a system that may be worn as an article of clothing, such as a pair of shorts. It is yet another object and feature of the present invention to provide such a system that provides weep openings to allow fluid to drain from support areas around the perimeter of the waterproof encasement.

A further object and feature of the present invention is to provide such a system that is efficient, inexpensive and handy. Other objects and features of this invention will become apparent with reference to the following descriptions.

SUMMARY OF THE INVENTION

In accordance with a preferred embodiment hereof, this invention provides a liquid-submersible personal storage system suitable for waterproof storage of personal accessories adjacent the body of a wearer, comprising in combination: at least one liquid-impermeable case, structured and arranged to encase the personal accessories; wherein such at least one liquid-impermeable case comprises: at least one pouch, structured and arranged to contain the personal accessories, such at least one pouch comprising at least one access aperture structured and arranged to permit access to the personal accessories enclosed within such case; and at least one cap structured and arranged to removably seal such at least one access aperture; at least one support structured and arranged to support such at least one liquid-impermeable case adjacent the body of the wearer; wherein such at least one support is structured and arranged so that, when worn: such at least one cap is essentially parallel with an adjacent body portion of the wearer; and at least one flexible pouch is deformable, in use, between such at least one cap and the adjacent body portion of the wearer; and wherein such at least one access aperture permits passage of at least one thumb and at least one finger of an adult hand.

Moreover, it provides such a system wherein: such at least one access aperture comprises at least one screw-threadable engagement; and such at least one cap comprises at least one screw-threadable engager structured and arranged to threadably engage such at least one access aperture. Additionally, it provides such a system wherein such at least one cap comprises at least one grip assister structured and arranged to assist the wearer in gripping such at least one cap. Also, it provides such a system wherein: such at least one cap further comprises at least one retainer structured and arranged to retain such at least one cap to such at least one liquid-impermeable case; and such at least one retainer is structured and arranged to permit removal and sealing of such at least one access aperture by such at least one cap.

In addition, it provides such a system wherein such at least one pouch comprises at least one flexibly-conforming material structured and arranged to flexibly conform to the adjacent body portion of the wearer. And, it provides such a system wherein such at least one flexibly-conforming material comprises at least one moldable polymer. Further, it provides such a system wherein such at least one moldable polymer comprises blow-moldable, low-density polyethylene. Even further, it provides such a system wherein such at least one support comprises at least one cushion structured and arranged to cushion the adjacent body portion of the wearer from the personal accessories contained within such at least one liquid-impermeable case.

Moreover, it provides such a system wherein such at least one support comprises at least one protector structured and arranged to protect such at least one access aperture. Additionally, it provides such a system wherein such at least one protector comprises at least one cover flap. Also, it provides such a system wherein such at least one cover flap comprises at least one fastener structured and arranged to removably fasten such at least one protector in a position over such at least one access aperture. In addition, it provides such a system wherein such at least one fastener comprises at least one hook-and-loop fastener.

Furthermore, it provides such a system wherein such at least one support comprises a water-resistant outer cover structured and arranged to substantially cover such at least one liquid-impermeable case. And, it provides such a system wherein such at least one liquid-impermeable case is permanently fixed to such at least one support. Additionally, it provides such a system wherein such at least one outer cover comprises at least one neoprene sleeve.

Even further, it provides such a system wherein such at least one outer cover comprises at least one article of clothing. Even further, it provides such a system wherein such at least one article of clothing comprises short trousers. Even further, it provides such a system wherein such at least one support comprises at least one belt structured and arranged to permit such at least one support to be maintained adjacent the body of the wearer. Moreover, it provides such a system wherein such at least one belt comprises: at least one clasp retainer structured and arranged to clasp and removably retain such at least one belt adjacent the body of the wearer; and at least one length adjuster structured and arranged to adjust the length of such at least one belt.

It also provides such a system wherein said at least one support comprises at least one weep opening structured and arranged to allow fluid to pass through said at least one weep opening. And, it provides such a system wherein said at least one support comprises at least one weep opening. It also provides such a system wherein said at least one neoprene sleeve comprises at least one weep opening structured and arranged to allow fluid to pass through said at least one weep opening.

In accordance with another preferred embodiment hereof, this invention provides a liquid-submersible personal storage system suitable for waterproof storage adjacent the body of a wearer, comprising in combination: at least one personal accessory; at least one liquid-impermeable case, to encase such at least one personal accessory; wherein such at least one liquid-impermeable case comprises: at least one pouch, to contain such at least one personal accessory, such at least one pouch comprising at least one access aperture arranged to permit access to such at least one personal accessory enclosed within such case; and at least one cap to removably seal such at least one access aperture; at least one support arranged to support such at least one liquid-impermeable case adjacent the body of the wearer; wherein such at least one support is arranged so that, when worn: such at least one cap is essentially parallel with an adjacent body portion of the wearer; and at least one flexible pouch is deformable, in use, between such at least one cap and the adjacent body portion of the wearer; and wherein such at least one access aperture permits passage of at least one thumb and at least one finger of an adult hand. It also provides such a system wherein said at least one support comprises at least one weep opening structured and arranged to allow fluid to pass through said at least one weep opening.

DETAILED DESCRIPTION OF THE BEST MODE AND PREFERRED EMBODIMENTS OF THE INVENTION

Figure 1:
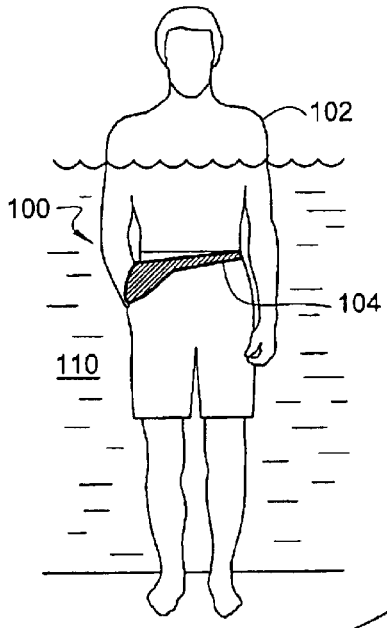
FIG. 1 shows a perspective view, partially in section, of a waterproof personal storage system worn about the waist of a submerged swimmer according to a preferred embodiment of the present invention.

FIG. 1 is a diagrammatic sectional view of waterproof personal storage system 100 worn about the waist of a submerged swimmer 102, according to a preferred embodiment of the present invention. In the embodiment of FIG. 1, waterproof personal storage system 100 is preferably configured as a belt-supported waist pack 104, as shown. Preferably, waterproof personal storage system 100 provides a means for protected storage of personal accessories by providing secure waterproof encasement about stored personal accessories, as shown. Preferably, all materials used in the construction of waterproof personal storage system 100 are waterproof and/or water-resistant to permit prolonged and repeated submersion in water 110, as shown.

Figure 2:
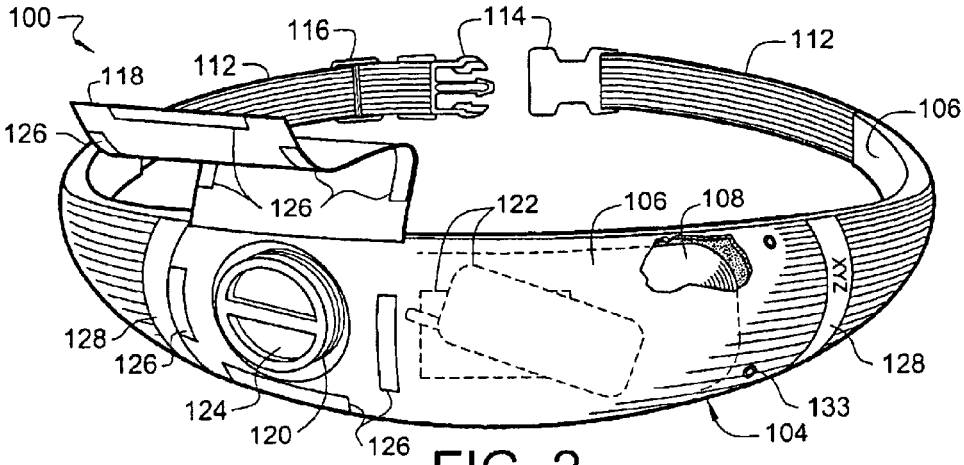
FIG. 2 shows a front perspective view of the waterproof personal storage system according to the preferred embodiment of FIG. 1.

FIG. 2 is a perspective view of waterproof personal storage system 100, according to the preferred embodiment of FIG. 1. Preferably, the waist pack embodiment of waterproof personal storage system 100 consists of a sheath-like protective outer covering 106 (herein embodying at least one support structured and arranged to support such at least one liquid-impermeable case adjacent the body of the wearer) that supports and encloses a flexible inner waterproof pouch 108, as shown. Inner waterproof pouch 108 preferably contains an access aperture 120 through which the user may insert and remove stored personal accessories 122 (as further described in FIG. 4 below). Removable screw-threaded cap 124 (herein embodying at least one cap structured and arranged to removably seal such at least one access aperture) is preferably used to seal access aperture 120 to block the passage of water into inner waterproof pouch 108, as shown. Preferably, protective cover flap 118 (herein embodying wherein such at least one support comprises at least one protector structured and arranged to protect such at least one access aperture) is sewn or otherwise attached to protective outer covering 106 to cover and protect screw-threaded cap 124, as shown. One or more fasteners, preferably hook-and-loop fasteners 126, are used to securely position and retain protective cover flap 118 in place over access aperture 120, as shown. Upon reading this specification those of skill in the art will understand that, under appropriate circumstances, such as availability of materials, user preference, etc., other fasteners, such as snaps, zippers, buttons, magnets, etc., may suffice.

Preferably sewn or otherwise attached to protective outer covering 106 is waist belt 112, which includes two-part connector 114 and belt length adjuster 116, as shown. Under appropriate circumstances, additional exterior detailing (such as indicia-containing banding 128) may be applied to waist belt 112, as shown. Preferably, weep holes 133 may be provided in protective outer covering 106 to permit fluid drainage.

Figure 3:
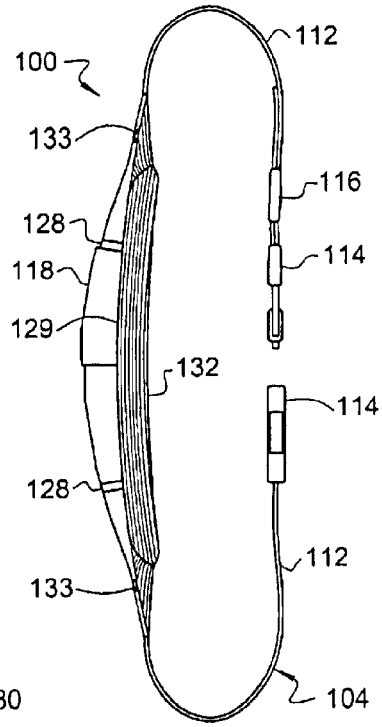
FIG. 3 shows a top view of the waterproof personal storage system of FIG. 2.

FIG. 3 is a top view of waterproof personal storage system 100, according to the preferred embodiment of FIG. 2. Preferably, waist pack 104 has a compact body-conforming shape, as shown. In all embodiments of the present invention, access to waist pack 104 through protective outer covering 106 is preferably oriented away from the body of the wearer with screw-threaded cap 124 positioned approximately parallel to the body of the wearer (herein embodying wherein such at least one support is structured and arranged so that, when worn: such at least one cap is essentially parallel with an adjacent body portion of the wearer). Protective outer covering 106 is preferably constructed from a waterproof or water-resistant material, preferably having both flexible and elastic qualities, most preferably consisting of a closed-cell synthetic rubber, such as neoprene. To provide a durable and attractive finish, a neoprene "wet-suit"-type material, having a soft nylon fabric facing bonded onto the outer surface of the water-impermeable neoprene material, is highly preferred. Preferably, neoprene having a thickness of about 1.5 mm to 2 mm is preferred, however, under appropriate circumstances, a thickness of up to about 6 mm may preferably be used if greater protection of inner waterproof pouch 108 is required. Outer covering 106 is preferably assembled by sewing multiple panels of neoprene fabric together using over-lock seam 129 (wherein two panels of neoprene are sewn along the edge as the two panels are held together with both outside surfaces in contact). Over-lock seam stitching results in a raised seam on the inside of the outer cover, with no stitching visible on the outside. Under appropriate circumstances, other methods of assembling protective outer covering 106 may suffice, for example, blind-stitching, flat-lock seaming, seam-taping and/or bonding may be used to form seam 129. Under appropriate circumstances, other waterproof and water-resistant outer covering materials or combinations of materials may be used in the construction of protective outer covering 106 (not limited to rubber, nylon, polyester, polymer-coated and "Gortex" fabrics).

Furthermore, it is preferred that the protective outer covering 106 comprises weep openings 133 (embodying herein wherein said at least one support comprises at least one weep opening) to allow water to pass out of the protective outer covering 106 and to provide a means for allowing the inner portion of the protective outer covering 106 to dry out (a weep opening being defined as an opening to permit the giving off or leaking of fluid). Most preferably, multiple weep openings 133 are provided in each waist pack 104, as shown. Preferably, the weep openings 133 are circular, preferably about one-eighth to about one-quarter inch in diameter. Preferably, a small grommet having the desired central opening is utilized for the weep opening and is preferably sewn into the outer covering 106. When the outer covering is neoprene, the weep opening 133 is preferably a small grommet opening (embodying herein wherein said at least one neoprene sleeve comprises at least one weep opening structured and arranged to allow fluid to pass through said at least one weep opening). Upon reading this specification it will be understood by those of ordinary skill in the art that under appropriate circumstances, considering issues such as economics, user preference, durability, etc., other methods of providing a weep opening, such as sewn fabric openings, etc., may suffice.

Figure 4:
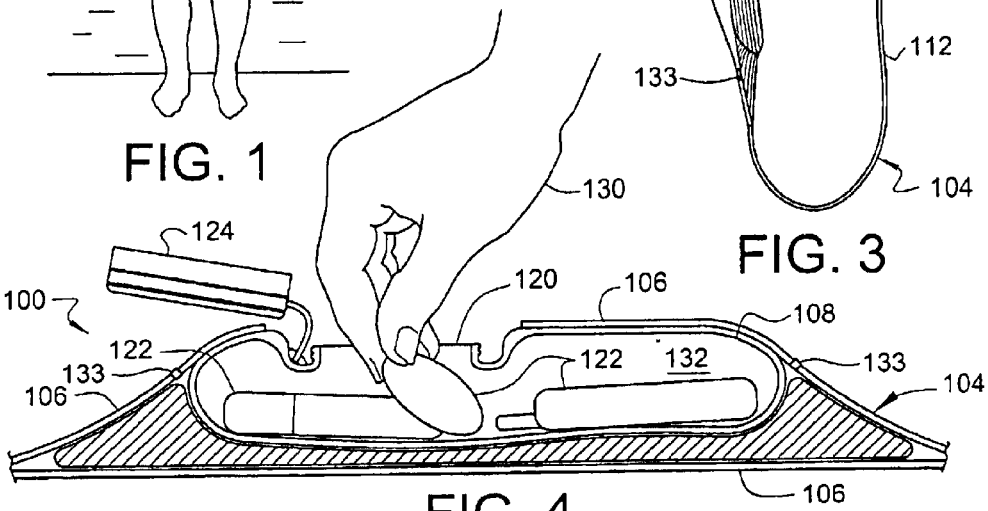
FIG. 4 shows a diagrammatic view, partially in section, illustrating a user accessing personal accessories stored within the waterproof personal storage system of FIG. 2.

FIG. 4 is a diagrammatic sectional view of user 130 accessing personal accessories 122 stored within waterproof personal storage system 100, according to the preferred embodiment of FIG. 2. Preferably, the inside diameter of access aperture 120 is sized to permit user 130 to comfortably pass a thumb and at least one finger into the interior portion 132 of inner waterproof pouch 108 and to permit a wide range of personal accessories 122 to be passed through the opening, as shown (herein embodying wherein such at least one access aperture permits passage of at least one thumb and at least one finger of an adult hand). It has been determined through practical experimentation that an access aperture 120 having an inside diameter of about 3½" is preferable for most applications. It should be noted that, under appropriate circumstances, access aperture 120 may be of a greater or smaller diameter size to accommodate specific storage applications (ranging from a minimum diameter of about 2" to a maximum of about 6").

Figure 5:
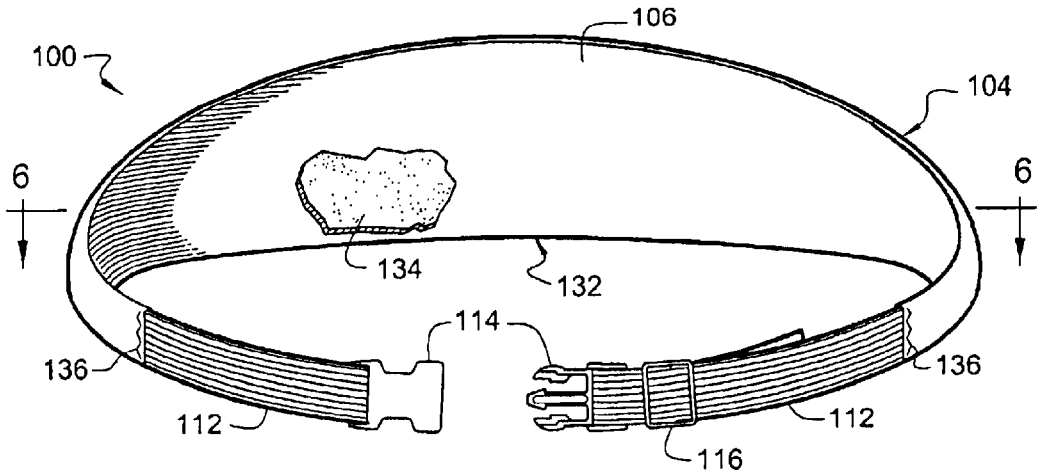
FIG. 5 shows a rear perspective view of the waterproof personal storage system of FIG. 2.

FIG. 5 is a rear perspective view of waterproof personal storage system 100, according to the preferred embodiment of FIG. 2. Preferably, back panel 132 of waist pack 104 consists of protective outer covering 106 over resilient padding 134 (herein embodying wherein such at least one support comprises at least one cushion structured and arranged to cushion the adjacent body portion of the wearer from the personal accessories contained within such at least one liquid-impermeable case), as shown. Waist belt 112 is preferably constructed from flat nylon webbing having a preferred width of about 1", as shown. Preferably, two-part connector 114 is similar in construction to side release buckle assembly No. P006, produced by Universal Mercantile Exchange, Inc., of Baldwin Park, Calif., U.S.A. Waist belt 112 is preferably attached to protective outer covering 106 by machine sewing along seams 136, as shown. Upon reading this specification it will be understood by those of skill in the art that under appropriate circumstances, such as user preference, availability of materials, economics, etc., other means of fastening waist pack 104 about the waist of the user, such as snaps, ties, buckles, hook and loop fasteners, etc., may suffice. For example, the ends of protective outer covering 106 may be formed into belt-like extensions removably connected by hook-and-loop fasteners.

Figure 6:
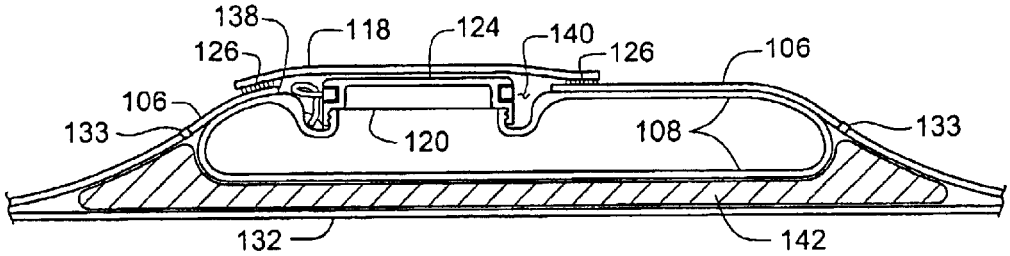
FIG. 6 shows a sectional view through section 6—6 of FIG. 5.

FIG. 6 is the sectional view 6—6 of FIG. 2 and FIG. 5 illustrating a preferred interior configuration of waterproof personal storage system 100, according to the preferred embodiment of FIG. 2. Preferably, inner waterproof pouch 108 is securely and permanently positioned within protective outer covering 106; however, protective outer covering 106 and inner waterproof pouch 108 are preferably separate elements, without mechanical or similar bonding between the two elements. This preferred arrangement permits a high degree of flexibility and movement within inner waterproof pouch 108 (thereby creating a versatile holder for containing a wide range of accessories and further allowing inner waterproof pouch 108 to be deformable, in use, between screw-threaded cap 124 and the adjacent body portion of the wearer). Under appropriate circumstances, outer covering 106 may be bonded to inner waterproof pouch 108, along the perimeter of cover opening 138, to create a double protective layer of waterproof material.

Preferably, access aperture 120 is positioned within a shallow, integrally-formed, indentation 140 within inner waterproof pouch 108, permitting the top of screw-threaded cap 124 to reside approximately flush with the outer face of inner waterproof pouch 108, as shown. As illustrated in FIG. 6, a pre-formed, resilient pad 142 is positioned between inner waterproof pouch 108 and back panel 132 to cushion the body of the wearer from accessories contained within inner waterproof pouch 108. Preferably, resilient pad 142 consists of closed-cell molded foam, such as gas-blown neoprene. Under appropriate circumstances, it may be preferred to omit resilient pad 142 to provide, for example, a less costly or especially compact waterproof personal storage system 100. FIG. 6 further illustrates protective cover flap 118 in the preferred closed and secure position over access aperture 120 and screw-threaded cap 124. The preferred applications of hook-and-loop fasteners 126, sewn or otherwise attached to the perimeter of cover opening 138 and the underside of protective cover flap 118, is also shown.

Figure 7:
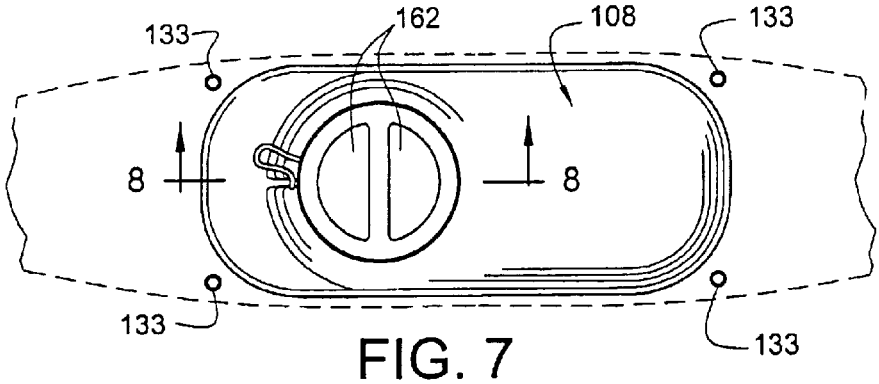
FIG. 7 shows a front view, partially in section, of the waterproof pouch retained within the waterproof personal storage system according to the preferred embodiments of the present invention.

FIG. 7 is a front view of a typical inner waterproof pouch 108 as retained within waterproof personal storage system 100, according to the preferred embodiments of the present invention. Preferably, inner waterproof pouch 108 (herein embodying at least one liquid-impermeable case, structured and arranged to encase the personal accessories; wherein such at least one liquid-impermeable case comprises: at least one pouch, structured and arranged to contain the personal accessories, such at least one pouch comprising at least one access aperture structured and arranged to permit access to the personal accessories enclosed within such case) and is a seamless design consisting of a flexible, liquid-impermeable, blow-moldable, polymeric material, such as low-density polyethylene (PE-LD). The preferred use of a blow-molding process in the production of inner waterproof pouch 108 produces a seamless and highly waterproof product, greatly reducing the potential of seam failure and leakage. Under appropriate circumstances, other materials (such as rubber, silicone rubber, or neoprene) and other construction methods (such as thermal seaming) may be used to accommodate such factors as production costs and/or ease of assembly. Although the preferred inner waterproof pouch 108 is illustrated as an essentially rectilinear molding, it should be noted that the shape and size of inner waterproof pouch 108 is not limited, and may be of alternate configuration, to meet the requirements of specific storage applications.

Grip-assisting recesses 162 are preferably formed into the top of screw-threaded cap 124 to assist the user in rotating the assembly on and off, as shown.

Figure 8:
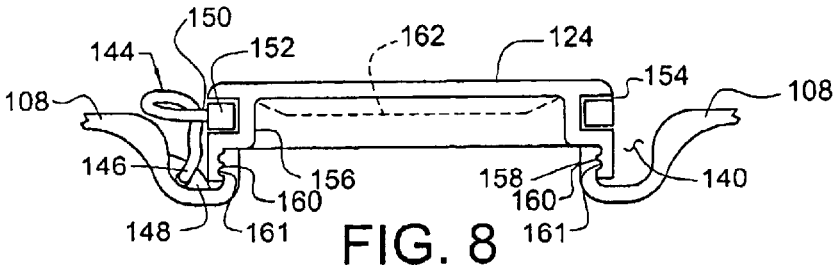
FIG. 8 shows a sectional view through section 8—8 of FIG. 7.

FIG. 8 is the sectional view 8—8 of FIG.7 illustrating the configuration of screw-threaded cap 124 of inner waterproof pouch 108, according to the embodiment of FIG. 7. Preferably, screw-threaded cap 124 is constructed of a medium to high-density moldable plastic polymer, such as polypropylene, and preferably includes a set of integral threads 160, as shown. A grip-assisting recess 162 (herein embodying wherein such at least one cap comprises at least one grip assister structured and arranged to assist the wearer in gripping such at least one cap) is preferably formed into the top of screw-threaded cap 124 to assist the user in rotating the assembly on and off, as shown. Preferably, lanyard 144 is used to retain screw-threaded cap 124 to inner waterproof pouch 108, as shown (herein embodying wherein such at least one cap further comprises at least one retainer structured and arranged to retain such at least one cap to such at least one liquid-impermeable case; and such at least one retainer is structured and arranged to permit removal and sealing of such at least one access aperture by such at least one cap). Lanyard 144 preferably consists of a molded flexible polymer element having a first end 146 secured to apertured tab 148 of inner waterproof pouch 108, and a second end 150 rotatably attached to screw-threaded cap 124, as shown. Ring-shaped element 152 of second end 150 is preferably positioned within continuous receiving channel 154 circumferentially formed within the perimeter sidewall 156 of screw-threaded cap 124, as shown. Preferably, lanyard 144 firmly retains screw-threaded cap 124 to inner waterproof pouch 108 while permitting the user to freely rotate screw-threaded cap 124 without risk of detachment and loss. Under appropriate circumstances, other methods of retaining screw-threaded cap 124 may be utilized (e.g., lanyard cord attachment to protective outer covering 106). Preferably, access aperture 120 consists of neck portion 158 having a complementary set of integral threads 161, as shown (herein embodying such at least one access aperture comprises at least one screw-threadable engagement; and such at least one cap comprises at least one screw-threadable engager structured and arranged to threadably engage such at least one access aperture).

Under appropriate circumstances, various adjoining sections of neck portion 158 and indentation 140 may have a greater wall thickness to provide increased stiffness, thereby permitting portions of inner waterproof pouch 108 to remain in its preferred shape, as shown. Preferably, screw-threaded cap 124 is self-sealing when engaged on neck portion 158. However, under appropriate circumstances, other sealing means (such as, for example, applied gaskets) may be used to increase water-resistance.

Figures 9, 10, 11:
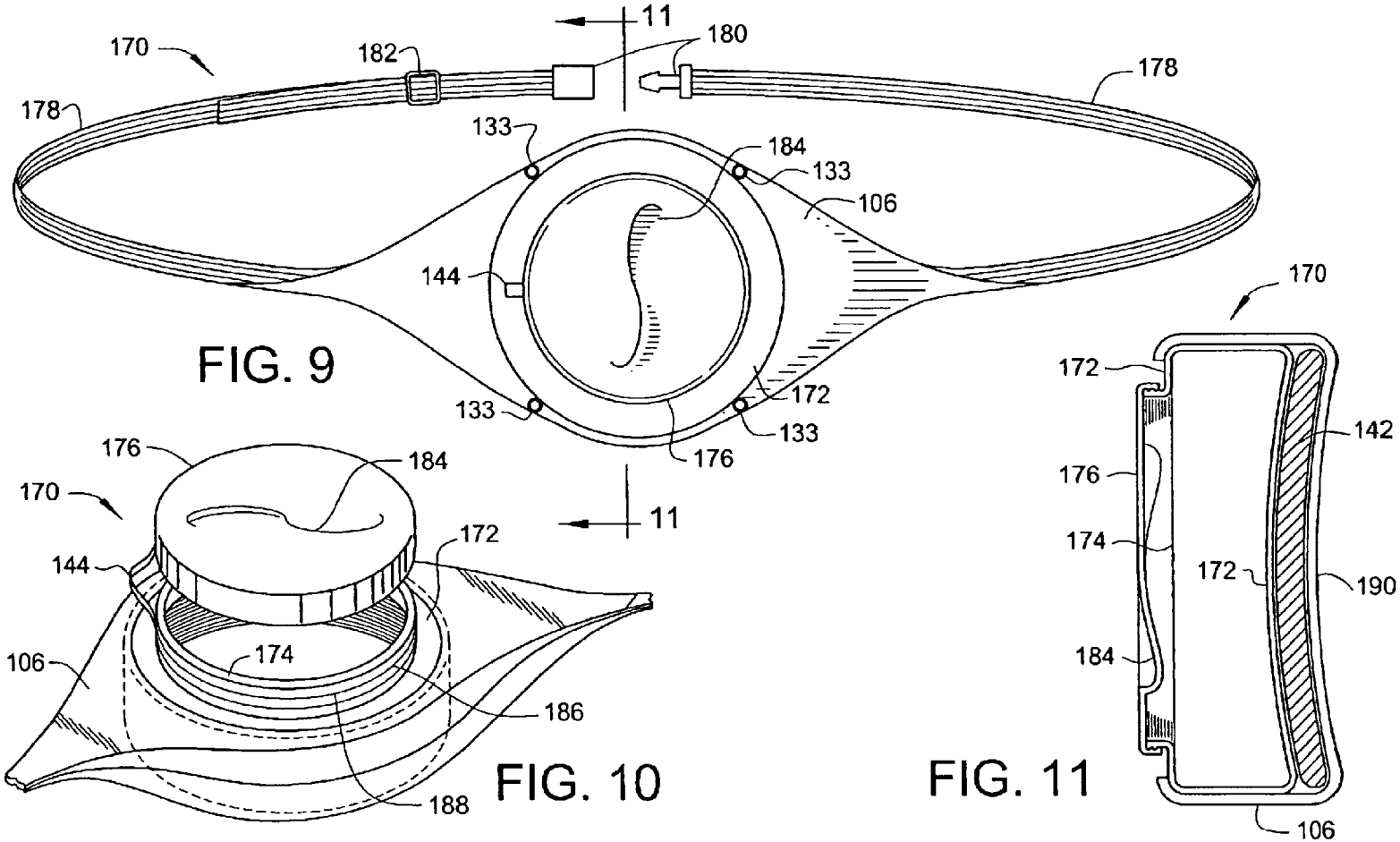
FIG. 9 shows a perspective view of a compact waterproof personal storage system according to another preferred embodiment of the present invention.
FIG. 10 shows a perspective view, partially in section, of the compact waterproof personal storage system of FIG. 9.
FIG. 11 shows a sectional view through section 11—11 of FIG. 9.

FIG. 9 is a perspective view of compact waterproof personal storage system 170, according to another preferred embodiment of the present invention. Preferably, compact waterproof personal storage system 170 consists of a sheath-like protective outer covering 106 supporting and enclosing a flexible to semi-rigid inner waterproof pouch 172 (herein embodying at least one liquid-impermeable case, structured and arranged to encase the personal accessories; wherein such at least one liquid-impermeable case comprises: at least one pouch, structured and arranged to contain the personal accessories, such at least one pouch comprising at least one access aperture structured and arranged to permit access to the personal accessories enclosed within such case), as shown. Preferably, inner waterproof pouch 172 is approximately circular in shape, having an outer diameter of about 5" to 6½", and a thickness of 1½" to 2½", as shown. Inner waterproof pouch 172 is preferably formed with an access aperture 174 (not shown, covered by screw-threaded cap 176) through which the user may insert and remove stored personal accessories 122 (not shown). An attached screw-threaded cap 176 (herein embodying at least one cap structured and arranged to removably seal such at least one access aperture), having a preferred diameter of 4" to 5½", is preferably constructed from plastic and is used to block the passage of water through access aperture 174. Upon reading this specification it will be understood by those of skill in the art that under appropriate circumstances, such as cost, ease of fabrication and storage application, other sizes and configurations, such as square, triangular, waist-sized, thigh-sized, backpack-sized, etc., may suffice.

Preferably sewn or otherwise attached to protective outer covering 106 is waist belt 178, which further comprises two-part connector 180 and belt length adjuster 182, as shown. As in the prior embodiments of FIG. 1 through FIG. 7, protective outer covering 106 is preferably constructed from a "wet-suit"-type neoprene, however, under appropriate circumstances, other materials, including nylon, cotton, polyester, and rubber, may suffice. Preferably, waist belt 178 consists of narrow flat nylon webbing or cording, as shown.

Preferably, screw-threaded cap 176 is connected to inner waterproof pouch 172 by lanyard 144, as described in the previous embodiment. Grip-assisting indentations 184 are preferably formed into the outer surface of screw-threaded cap 176, as shown.

Furthermore, as described above, it is preferred that the protective outer covering 106 comprises weep openings 133 to allow water to pass out of the protective outer covering 106 and to provide a means for allowing the inner portion of the protective outer covering 106 to dry out. Most preferably, multiple weep openings 133 are provided, as shown. Preferably, the weep openings 133 are circular, preferably about one-eighth to about one-quarter inch in diameter. Preferably, a small grommet having the desired central opening is utilized for the weep opening and is preferably sewn into the outer covering 106. Upon reading this specification it will be understood by those of skill in the art that under appropriate circumstances, such as economics, user preference, durability, etc., other methods of providing a weep opening, such as sewn fabric openings, unbound holes, etc., may suffice.

FIG. 10 is a partial perspective view of compact waterproof personal storage system 170, according to the preferred embodiment of FIG. 9. Grip-assisting indentations 184 are preferably formed into the outer surface of screw-threaded cap 176, as shown. Screw-threaded cap 176 may, under appropriate circumstances, be constructed of thin, lightweight metal or metallic-finished plastic. Injection or blow-molding using a polymer, such as polyethylene, is preferably used to form inner waterproof pouch 172. Preferably, inner waterproof pouch 172 is securely sewn within protective outer covering 106 (herein embodying at least one support structured and arranged to support such at least one liquid-impermeable case adjacent the body of the wearer), as shown. Inner waterproof pouch 172 preferably includes a raised annular neck portion 186 around access aperture 174 having a set of integrally-formed receiving threads 188, as shown.

FIG. 11 is the sectional view 11—11 of FIG. 9, illustrating a preferred interior configuration of compact waterproof personal storage system 170, according to the embodiment of FIG. 9. Preferably, a pre-formed, resilient pad 142 is positioned between inner waterproof pouch 172 and back panel 190 to cushion the body of the wearer, as shown. Resilient pad 142 may also be used to permit compact waterproof personal storage system 170 to retain a desired shape, as shown. Under appropriate circumstances, other shape-retaining assemblies (such as, for example, molded plastic inserts) may be used to maintain the preferred shape of compact waterproof personal storage system 170.

Figure 12:
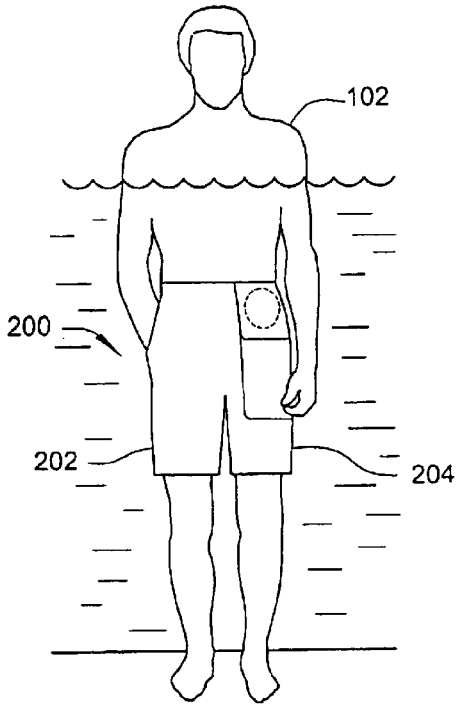
FIG. 12 shows a perspective view, partially in section, of a waterproof personal storage system as an article of clothing worn by a submerged swimmer according to another preferred embodiment of the present invention.

FIG. 12 is a diagrammatic sectional view of a waterproof personal storage system 200 worn as an article of clothing 202 by a submerged swimmer 102, according to a highly preferred embodiment of the present invention. In the embodiment of FIG. 12, the preferred article of clothing 202 is a pair of short trousers 204. It should be noted that the scope of the present invention will include other clothing embodiments that are preferably adapted to be worn by a person. Further, the term "article of clothing" may preferably include other outer body covering arrangements not limited to bathing suits, wet/dry thermal suits, pants, shirts, vests and the like.

Figure 13:
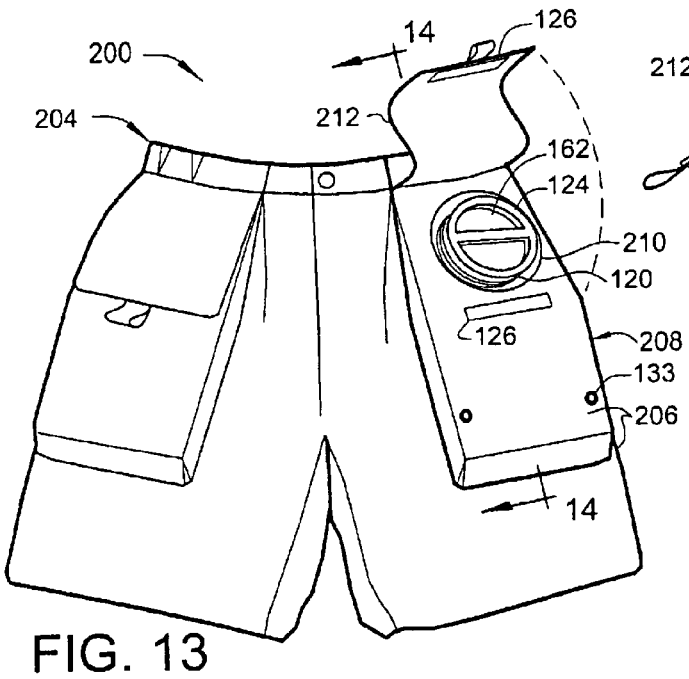
FIG. 13 shows a detailed perspective view of the waterproof personal storage system of FIG. 12.

FIG. 13 is a perspective view of clothing-type waterproof personal storage system 200, according to the preferred embodiment of FIG. 12. Preferably, short trousers 204 consist of a wearable outer cover 206 (herein embodying at least one support structured and arranged to support such at least one liquid-impermeable case adjacent the body of the wearer) consisting of one or more waterproof or water-resistant fabrics that may preferably include cotton, nylon, polyester or neoprene. Preferably, short trousers 204 are constructed with pocket 208, adapted to support and retain inner waterproof pouch 108 (not shown, contained by pocket 208) adjacent to the body of the wearer, as shown. Preferably, pocket 208 permits access to inner waterproof pouch 108 through pocket opening 210, as shown. Unless otherwise noted, inner waterproof pouch 108 is preferably identical in material and construction to the illustrated inner waterproof pouch 108 of FIG. 1 through FIG. 8. Clothing-type waterproof personal storage system 200 preferably includes protective cover flap 212 (herein embodying wherein such at least one support comprises at least one protector structured and arranged to protect such at least one access aperture), sewn or otherwise attached to wearable outer cover 206, as shown. Preferably, protective cover flap 212 covers and protects screw-threaded cap 124 and access aperture 120, as shown. One or more fasteners, preferably hook-and-loop fasteners 126, are used to securely position and retain protective cover flap 212 in place over screw-threaded cap 124 and access aperture 120, as shown. Grip-assisting indentations 162 are preferably formed into the outer surface of screw-threaded cap 124, as shown. Also, weep holes 133 may be provided in wearable outer cover 206, as shown.

Figure 14:
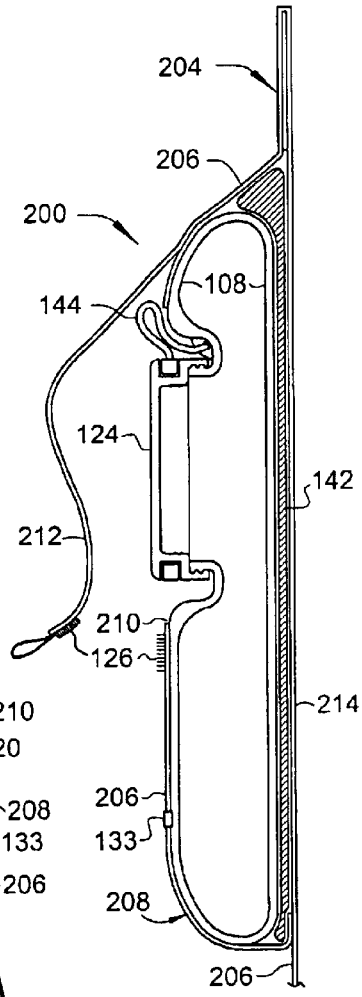
FIG. 14 shows a sectional view through section 14—14 of FIG. 13.

FIG. 14 is the sectional view 14—14 of FIG. 13, illustrating a preferred configuration of the wearable waterproof personal storage system 200, according to the embodiment of FIG. 12. Access to inner waterproof pouch 108 through wearable outer cover 206 is preferably oriented away from the body of the wearer with screw-threaded cap 124 positioned approximately parallel to the body of the wearer (herein embodying wherein such at least one support is structured and arranged so that, when worn: such at least one cap is essentially parallel with an adjacent body portion of the wearer). Preferably, inner waterproof pouch 108 is securely and permanently positioned within pocket 208, however, pocket 208 and inner waterproof pouch 108 are preferably separate elements without inter-attachment or bonding. This preferred arrangement permits a high degree of flexibility and movement within inner waterproof pouch 108 (thereby creating a versatile container for holding a wide range of accessories). Under appropriate circumstances, pocket 208 may be bonded to inner waterproof pouch 108, along the perimeter of pocket opening 210, to create a double protective layer of waterproof material. Preferably, a resilient pad 142 is positioned between inner waterproof pouch 108 and wearable inner cover 214 to protect the body of the wearer from accessories contained within inner waterproof pouch 108. Preferably, resilient pad 142 consists of closed-cell molded foam, such as gas-blown neoprene. Under appropriate circumstances, it may be preferred to omit resilient pad 142 to provide, for example, a less costly or especially lightweight embodiment of short trousers 204. It is noted that the wearable outer cover 206 preferably comprises weep openings 133 and lanyard 144 as described above and as shown herein.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A liquid-submersible personal storage system, suitable for waterproof storage of personal accessories adjacent a body of a wearer, comprising, in combination:

a) at least one liquid-impermeable case structured and arranged to encase the personal accessories;

b) wherein said at least one liquid-impermeable case comprises i) at least one pouch, structured and arranged to contain the personal accessories, said at least one pouch comprising at least one access aperture structured and arranged to permit access to the personal accessories enclosable within said case, and ii) at least one cap structured and arranged to removably seal said at least one access aperture;

c) at least one support structured and arranged to support said at least one liquid-impermeable case adjacent the body of the wearer;

d) wherein said at least one support is structured and arranged so that, when said at least one support is worn by the wearer, i) said at least one cap is essentially parallel with an adjacent body portion of the wearer, and ii) said at least one flexible pouch is in use deformable between said at least one cap and the adjacent body portion of the wearer; and e) wherein said at least one access aperture is structured and arranged to permit passage of at least one thumb and at least one finger of an adult hand.

2. The system according to claim 1 wherein:

a) said at least one access aperture comprises at least one screw-threadable engagement; and b) said at least one cap comprises at least one screw-threadable engager structured and arranged to threadably engage said at least one screw-threadable engagement.

3. The system according to claim 2 wherein said at least one cap comprises at least one grip assister structured and arranged to assist the wearer in gripping said at least one cap.

4. The system according to claim 3 wherein:

a) said at least one cap further comprises at least one retainer structured and arranged to retain said at least one cap to said at least one liquid-impermeable case; and b) said at least one retainer is structured and arranged to permit removal of said at least one cap and sealing of said at least one access aperture by said at least one cap.

5. The system according to claim 4 wherein said at least one pouch comprises at least one flexibly-conforming material structured and arranged to flexibly conform to the adjacent body portion of the wearer.

6. The system according to claim 5 wherein said at least one flexibly-conforming material comprises at least one moldable polymer.

7. The system according to claim 6 wherein said at least one moldable polymer comprises blow-moldable low-density polyethelene.

8. The system according to claim 5 wherein said at least one support comprises at least one cushion structured and arranged to cushion the adjacent body portion of the wearer from the personal accessories containable within said at least one liquid-impermeable case.

9. The system according to claim 5 wherein said at least one support comprises at least one protector structured and arranged to protect said at least one access aperture.

10. The system according to claim 9 wherein said at least one protector comprises at least one cover flap.

11. The system according to claim 10 wherein said at least one cover flap comprises at least one fastener structured and arranged to removably fasten said at least one protector in a position over said at least one access aperture.

12. The system according to claim 11 wherein said at least one fastener comprises at least one hook-and-loop fastener.

13. The system according to claim 1 wherein said at least one support comprises at least one water-resistant outer cover structured and arranged to substantially cover said at least one liquid-impermeable case.

14. The system according to claim 13 wherein said at least one liquid-impermeable case is permanently fixed to said at least one support.

15. The system according to claim 13 wherein said at least one outer cover comprises at least one neoprene sleeve.

16. The system according to claim 13 wherein said at least one outer cover comprises at least one article of clothing.

17. The system according to claim 16 wherein said at least one article of clothing comprises short trousers.

18. The system according to claim 13 wherein said at least one support comprises at least one belt structured and arranged to permit said at least one support to be maintained adjacent the body of the wearer.

19. The system according to claim 18 wherein said at least one belt comprises:

a) at least one clasp retainer structured and arranged to clasp and removably retain said at least one belt adjacent the body of the wearer; and b) at least one length adjuster structured and arranged to adjust the length of said at least one belt.

20. The system according to claim 1 wherein said at least one support comprises at least one weep opening.

21. The system according to claim 15 wherein said at least one neoprene sleeve comprises at least one weep opening structured and arranged to allow fluid to pass through said at least one weep opening.

22. The system according to claim 17 wherein said at least one support comprises at least one weep opening.

23. A liquid-submersible personal storage system suitable for waterproof storage adjacent the body of a wearer comprising in combination:

a) at least one personal accessory;

b) at least one liquid-impermeable case encasing said at least one personal accessory; wherein said at least one liquid-impermeable case comprises i) at least one pouch containing said at least one personal accessory, said at least one pouch comprising at least one access aperture permitting access to said at least one personal accessory encased within said case, and ii) at least one cap to removably seal said at least one access aperture;

c) at least one support to support said at least one liquid-impermeable case adjacent the body of the wearer;

d) wherein said at least one support is arranged so that, when said at least one support is worn, i) said at least one cap is essentially parallel with an adjacent body portion of the wearer, and ii) at least one flexible pouch is in use deformable between said at least one cap and the adjacent body portion of the wearer; and e) wherein said at least one access aperture permits passage of at least one thumb and at least one finger of an adult hand.

24. The system according to claim 23 wherein said at least one support comprises at least one weep opening structured and arranged to allow fluid to pass through said at least one weep opening.

* * * * *